US011517094B1

(12) United States Patent
Zheng et al.

(10) Patent No.: US 11,517,094 B1
(45) Date of Patent: Dec. 6, 2022

(54) COSMETIC PACKAGE FOR DISCHARGING A POWDER PRODUCT

(71) Applicant: APR Beauty Group Inc, Toronto (CA)

(72) Inventors: Min-Yan Zheng, Ontario (CA); Feng-Ying Fu, Ontario (CA)

(73) Assignee: APR Beauty Group Inc, Toronto (CA)

( * ) Notice: Subject to any disclaimer, the term of this patent is extended or adjusted under 35 U.S.C. 154(b) by 17 days.

(21) Appl. No.: 17/335,334

(22) Filed: Jun. 1, 2021

(51) Int. Cl.

| | |
|---|---|
| ***A45D 33/12*** | (2006.01) |
| ***A45D 33/36*** | (2006.01) |
| ***A45D 33/24*** | (2006.01) |
| ***A45D 33/00*** | (2006.01) |

(52) U.S. Cl.
CPC ..... *A45D 33/12* (2013.01); *A45D 33/003* (2013.01); *A45D 33/24* (2013.01); *A45D 33/36* (2013.01)

(58) Field of Classification Search
CPC ..... A45D 33/12; A45D 33/26; A45D 33/24; A45D 33/003; A45D 33/00; A45D 33/006; A45D 34/041; A45D 34/04; A45D 40/261; A45D 40/26; B05C 17/02; B05C 17/0205; B05C 17/0215; B05C 17/025
USPC ..... 401/208, 209, 214, 216, 219
See application file for complete search history.

(56) References Cited

U.S. PATENT DOCUMENTS

| | | | | |
|---|---|---|---|---|
| 5,836,320 | A * | 11/1998 | Gueret | A45D 33/12 401/218 |
| 6,682,244 | B2 | 1/2004 | Gueret | |
| 8,356,952 | B2 | 1/2013 | Bennett et al. | |

FOREIGN PATENT DOCUMENTS

| | | | |
|---|---|---|---|
| GB | 446424 | A | 4/1936 |

* cited by examiner

*Primary Examiner* — David J Walczak
(74) *Attorney, Agent, or Firm* — Jason L DeFrancesco

(57) ABSTRACT

A cosmetic package comprising a roller for discharging a powder product. The cosmetic package comprises an outer cap, an inner cap, an insert, the roller, a container, and a base plug. The container has an open bottom end which is closed by the base plug. The insert is mounted within the container above a cosmetics accommodating space of the container. A bottom surface of the insert includes two support members for rotatably accommodating two axle projections of the roller such that at least a portion of the roller is disposed rotatably within the cosmetics accommodating space of the container and another portion of the roller extending outside the cosmetics accommodating space from an aperture located at a bottom end of the insert. The inner cap forms a tight seal with the insert and the roller to prevent leakage of powder product from the container.

20 Claims, 10 Drawing Sheets

COSMETIC PACKAGE FOR DISCHARGING A POWDER PRODUCT

BACKGROUND

Field

The present disclosure relates to a cosmetic package for discharging a powder product. More specifically, the present disclosure relates to a cosmetic package having a container for storing the powder product, wherein the cosmetic package includes a roller for discharging the powder product.

Description of the Related Art

Conventional cosmetic packages, for storing and discharging a powder product, usually comprise of a container for storing the powder product, and the powder product is discharged upon orientation of the cosmetic package in a defined angle. The powder product is usually discharged in an uncontrolled amount on to a surface and applied on a skin of the user with an applicator or fingers. The discharging of uncontrolled amount of powder product either leads to multiple dispensing of the powder product during application or dispensing an excessive amount of powder product which leads to a mess and wastage of the powder product. The applicator in these conventional cosmetic packages are usually desegregated from the cosmetic package and stored separately which ultimately leads to carrying of multiple containers.

U.S. Pat. No. 8,356,952 to Rexam Beauty and Closures, Inc., relates to a container for containing and dispensing a cosmetic product. The container includes a base defining a cavity for supporting a cosmetic product and an applicator (for example a trackball, etc.) movably supported at the base to allow a person user to selectively extract the cosmetic product of the cavity. The applicator includes a first portion and a second portion. The first portion is configured to be exposed to the liquid material when the second portion is exposed to the wearer. The container also comprises a lid connected to the base for covering the applicator.

The cover may be selectively moved between a closed position and an open position. The applicator is configured to be manipulated by the wearer so that the first portion is exposed to the individual user and that the second portion is exposed to the liquid material.

Existing packages deliver disconcerting experience to the user while using the cosmetic package for applying the powder product.

In order to overcome the aforementioned limitations, there exists a need of developing a cosmetic package that provides a mess free and controlled discharge of the powder product.

SUMMARY

It is an object of the present disclosure to provide a cosmetic package is configured to contain and dispense a powder product.

It is an object of the present disclosure to provide a cosmetic package that discharges a powder product in controlled amount.

It is another object of the present disclosure to provide a cosmetic package that incorporates an applicator along with a controlled discharging means (i.e. a roller) for reducing the requirement of carrying a separate container for the applicator.

The cosmetic package according to present disclosure is therefore designed for providing satisfactory user experience and making the cosmetic package travel friendly and mess-free.

A cosmetic package in accordance with a first embodiment comprises an outer cap, an applicator, an applicator holder, an inner cap, an insert, a roller, a container, and a base plug. The container stores a powder product that is to be discharged onto a surface of the roller, wherein the powder product is selected from at least one of the cosmetic powder products or medicinal powder products.

The powder product stored in the container is preferably a loose powder product.

The outer cap covers the cosmetic package and protects the cosmetic package from dust and dirt. The applicator holder comprises a sidewall defining an upper end and a bottom end of the applicator holder. The outer cap is mounted on the upper end applicator holder. The shape of the outer cap is preferably circular in shape. However, the shape of the outer cap may be rectangular, cuboidal, square, or other shapes known in the art.

The container comprises an open upper end and an open bottom end. The container includes a sidewall and a bottom wall defined by a separate base plug. The open bottom end of the container is closed by the base plug. The container is connected with the base plug at the bottom end, thus covering the bottom end of the container to store the powder product. The base plug is fixedly coupled to the container such that they behave as a single unit.

In an alternate embodiment, the base plug and the container may be made as a single integral piece.

According to an aspect of the present disclosure, the base plug is connected to the container at the bottom end by means of a snap fitment. However, the base plug may be connected to the container at the bottom end by any other fitment means such as screws, threads, or other fitment means known in the art.

The container has a cavity for accommodating the powder product, and more particularly, the powder product is located in the cosmetics accommodating space in the cavity of the container. Further, the sidewall of the container defines a neck portion near the open upper end of the container. The neck portion is reduced in outer diameter as compared with the rest of the sidewall. The shape of the container is a bowl-shaped container.

According to an aspect of the present disclosure, the dimensions of the container are sufficient enough to accommodate the roller and the insert. The insert is positioned within the container where it fits above the powder product contained within the cosmetic accommodating space of the cavity of the container. The insert is positioned co-axially inside the cavity of the container. The insert comprises an open bottom end and an open upper end. The insert has a hollow structure of a defined geometrical shape. More specifically, the insert is has a bowl-shaped structure. The insert further includes a sidewall, an upper horizontal rim, and a skirt wall. The sidewall is concave and shaped like a bowl. The bottom end of the insert fits within the open upper end of the container. An aperture is defined at the bottom end of the insert.

According to another aspect of the present disclosure, the insert further includes at least one protrusion, which may be positioned on an inside of the skirt wall of the insert and may be configured to engage with at least one corresponding groove present on an outer surface of a neck portion of the container. In this manner, the insert may be snap-fitted into the container and may be held within the cavity of the container.

When the insert is coupled with the container, the sidewall of the insert extends along the longitudinal direction of the container in the cavity of the container. The cosmetics accommodating space of the container is formed below the sidewall of the insert, and a space above the upper surface of the sidewall of the insert forms an inner cap receiving space therein. The inner cap receiving space is formed to have a larger cross sectional area towards the open upper end of the insert. At the bottom end of the sidewall of the insert, the aperture is formed. The inner cap receiving space and the cosmetic accommodating space form independent spaces with the aperture for dispensing the powder product therebetween with the help of the roller.

According to another aspect of the present disclosure, the insert may have a size and shape that corresponds with the size and shape of the container, thereby enclosing the powder product within the cosmetic accommodating space of the cavity of the container. The insert and the container may have a substantially round (e.g., circular or cylindrical) shape in which the seal may be provided by a suitable fastening mechanism, such as snap fastening. However, it is contemplated that the insert and the container may have an alternative shape (e.g., square, rectangular, oval, triangular, or any other shape desired) and may be sealed by a magnetic fastening mechanism, a threading mechanism, or a clamp fastening system.

According to another aspect of the present disclosure, a bottom surface of the sidewall of the insert comprises two support members that extend downwardly therefrom, and the two support members are positioned on at least two opposite sides of the aperture at the open bottom end of the insert.

The at least one end of each of the two support members and is connected to the bottom surface of the sidewall of the insert. Each of the other end of the two support members and is a free end. The two support members include opposing see-through cavities/holes. In various embodiments, the holes of the two support members may or may not be see-through.

In an exemplary embodiment, the roller is spherical in shape and is attached to the support members of the insert at the bottom end of the insert such that at least some portion of the roller is positioned within cosmetics accommodating space the cavity of the container, and at least another portion of the roller extends out from the cosmetics accommodating space through the aperture of the insert. The roller is configured to rotate in a defined direction about an axis for discharging a controlled amount of the powder product from the cosmetics accommodating space of the container through the aperture at the open bottom end of the insert. The powder product adheres on to an outer surface of the roller, on the rotation of the roller by a user. The user collects the powder product from the outer surface of the roller that is exposed from the aperture of the insert.

In alternate embodiments, the roller may be a cylindrical or an oval shape.

In an exemplary embodiment, the roller is manufactured in two parts and is later integrated to form a roller. The two parts of the roller comprised of two halves that are semi-spherical. The roller includes two opposing axle projections on the outer surface of the roller. Each of the two opposing axle projections is partially defined by two halves of the roller. The two halves of the roller are joined together to form the spherical roller and the axle projections. The see-through cavities present in the at least two support members and receive the two opposing axle projections and by which the roller is mounted in position. Thus, the two opposing axle projections of the roller are rotatably connected to the two support members of the insert for free rotation of the roller on a single axis. More particularly, the two support members of the insert comprises of a left support member and a right support member, wherein the left support member and the right support member are connected to the first axle projection and the second axle projection respectively. The roller rotates about an axis lying in direction of the interlocking of the two opposing axle projections with the two support members. At least a portion of the roller is exposed from the open bottom end of the insert for discharging a controlled amount of the powder product for the application.

According to another aspect of the present disclosure, at least a portion of the roller is exposed through the aperture at the bottom end of the insert for application. The roller can rotate in a clockwise and an anti-clockwise direction for discharging the powder product from the top portion. During rotation, an exposed top portion of the roller moves in a downward direction, and a bottom portion of the roller carries the powder product and moves in an upward direction for discharging the powder product. Meanwhile, the top portion of the roller moves downward, touches the powder product and carries a controlled quantity of powder product, and moves upward on further rotation. The movement of the roller covers a complete circle for continuously discharging the powder product during application.

According to another aspect of the present disclosure, the inner cap comprises an open upper end and a closed bottom end. The inner cap includes a flange projection at the upper end thereof, a bottom wall, and a sidewall extending downwardly from the flange projection. The inner cap has a size and shape that corresponds with the size and shape of the container and the insert. The inner cap may be configured to sit above the insert such that the flange projection of the inner cap rests on the upper horizontal rim of the insert, and the sidewall of the insert and the sidewall of the inner cap may flush with one another, thereby enclosing the powder product within the cavity of the container. When the inner cap is placed over the insert, the inner cap forms a tight seal with the insert and the roller to prevent leakage of powder product from the container. More particularly, the sidewall of the inner cap sealingly rests on an upper surface of sidewall of the insert. More particularly, an outer surface of the sidewall of the inner cap includes a protrusion that abuts and make a tight seal with an inner surface of the sidewall of the insert to prevent leakage of powder product from the container between the insert and the inner cap. Further, a bottom surface of the bottom wall of the inner cap includes an annular protrusion that rests on a top surface of the roller, which is exposed through the aperture, to tight seal and prevents leakage of powder product from the container. The annular protrusion creates a space between the bottom surface of the bottom wall of the inner cap and the top portion of the roller for the reception of a little quantity of the powder product. The diameter of the inner cap is substantially equal to the diameter of the insert.

According to an embodiment, the bottom wall of the inner cap is a convex structure forming a concave cavity at a bottom surface of the bottom wall of the inner cap. The concave cavity provides a space for accommodating the exposed top portion of the roller. The concave cavity is a semi-sphere having a diameter of at least one-third of the diameter of the roller.

According to an embodiment, the concave cavity of the bottom wall covers at least one-third portion of the roller. However, the diameter of the concave cavity of the base may be adjusted for covering a desired portion of the roller depending on the exposure of the roller from the aperture of the insert.

According to another aspect of the present disclosure, the applicator holder has an upper end and a bottom end. The applicator holder comprises a sidewall, a horizontal wall extending horizontally from an inner surface of the sidewall of the applicator holder. The horizontal wall includes a recess shaped and sized to receive and store the applicator therein. The recess of the applicator holder thus resembles the shape of the applicator. The user uses the applicator to rotate the roller for discharging and collecting the powder product from the outer surface of roller. An outer shape of the applicator holder resembles the outer shape of the cap. More specifically, the outer shape of the applicator holder is circular in shape. However, in alternate embodiments, the shape of the applicator holder and the outer cap may be rectangular, cuboidal, square, or other shapes known in the art. The length of the recess extends along the length of the horizontal wall. The applicator is protected from the external environment when the upper end of the applicator holder is covered by the cap.

According to another aspect of the present disclosure, the horizontal wall comprises an upper surface, a bottom surface, and wherein the recess formed on the upper surface of the horizontal wall for accommodating the applicator. The upper surface of the horizontal wall includes the recess and at least one clearance groove. More particularly, at least two clearance grooves are provided adjacent to the two sides of the recess, wherein the two clearance grooves are sized such that they provide space wherein the user can engage his/her fingers in order to remove the applicator from the recess of the applicator holder comfortably.

According to yet another aspect of the present disclosure, the bottom surface opposite to the upper surface of the horizontal wall of the applicator holder includes a first protrusion opposite to the recess and a second protrusion opposite to the clearance. The shape of the first protrusion depicts the shape of the applicator stored in the recess. The two sides of the first protrusion, each has a second protrusion. The second protrusions are formed due to the presence of the clearances on the opposite surface of the horizontal wall.

According to another aspect of the present disclosure, an inner surface of the sidewall of the applicator holder includes a fastening means that are engaged with corresponding fastening means provided on the outer surface of the neck portion of the container. According to the present embodiment, the fastening means is preferably a threaded means comprising of threads along an outer periphery of the neck portion of the container that fits with the threads of opposite profile present along the inner periphery of the sidewall of the applicator holder.

Furthermore, the open upper end of the inner cap is fixedly and non-rotatably engaged to a bottom side of the applicator holder. More particularly, the inner surface of the sidewall of the applicator holder includes a groove that is configured to receive the flange projection of the inner cap so in order to couple the inner cap with the applicator holder. Thus, when the applicator holder is unscrewed from the container, the inner cap comes off along with the applicator holder.

The insert and applicator holder are fastened to the open upper end of the container, thus positioning the inner cap and the insert co-axially inside the container.

According to another aspect of the present disclosure, the applicator touches the surface of the roller to collect the powder product upon rotation of the roller. In an embodiment, the applicator rotates the roller for discharging the powder product on the surface of the applicator. However, the roller may also be rotated using the fingers of the user or any other tool.

According to another aspect of the present disclosure, the applicator when placed in the applicator holder is protected from dust and dirt by the outer cap that covers the applicator holder. The outer cap is connected to the upper end of the applicator holder. The outer cap is hingly coupled to the sidewall of the applicator holder. The hinge allows the outer cap to be pivotally connected to the applicator holder by at least one side. The hinge is made proximate to the upper end on the sidewall of the applicator holder. More particularly, the applicator holder is fixedly coupled to outer cap about a hinge that provides for pivotal movement of the outer cap relative to applicator holder between an open position and a closed position. According to the embodiment illustrated, the hinge includes a pivot shaft pin that is received within the corresponding opening in the outer cap and applicator holder and that defines a pivot axis about which the outer cap is configured to rotate between the open position and the closed position. An outer surface of the sidewall of the applicator holder includes a locking member that engages with a corresponding locking member provided on an inner surface of the outer cap for securely engaging the outer cap with the applicator holder. More particularly, the outer cap includes a groove that interlocks with a protruded lock. The outer cap is opened by unlocking the protruded lock from the groove of the outer cap. The protruded lock is located circumferentially opposite to the hinge on the sidewall of the applicator holder.

According to an aspect of the present disclosure, when the applicator holder is mounted over the container, the recess of the applicator holder extends into a cavity of the inner cap. More particularly, a maximum depth of the recess of the applicator holder is such that the recess at its maximum depth extends more than half the depth of the cavity of the inner cap. Further, a depth of the recess of the applicator holder at a location other than the maximum depth of the recess extends less than half the depth of the cavity of the inner cap. More specifically, in the present embodiment, a portion of the recess that exceeds more than half the depth of the inner cap is configured to house an applicator head of the applicator. Another portion of the recess that extends less than half the depth of the cavity of the inner cap is configured to receive a handle portion of the applicator.

According to the first embodiment, the applicator holder is circular in shape and is identical to the shape of the container. However, the shape of the applicator holder may vary based on the shape of the applicator.

According to another aspect of the present disclosure, the bottom second surface of the horizontal wall of the applicator holder comprises a projection that interlocks with the notch of the inner cap so that the inner cap is rotationally locked with respect to the applicator holder.

In order to use the cosmetic package, the user pivotally opens the outer cap and removes the applicator from the recess of the applicator holder. The applicator is held and is removed easily by lifting the applicator from the recess by the clearance. Then, the applicator holder is unthreaded from the container, and wherein on unthreading the inner cap, and the outer cap is also removed along with the applicator holder as they are irremovably secured to the applicator holder. As the inner cap gets removed from the container, a user can access the powder product by rotating the roller exposed from the aperture of the insert. The user rotates the roller using the applicator in a direction perpendicular to the direction of the two axle projections. The applicator collects the powder product that gets adhered to the surface of the roller on rotation and transfers the powder product to the user's skin.

In alternate embodiments, not shown, the inner cap may not be fixedly assembled to the applicator holder. Thus, when the applicator holder is unscrewed from the container, the inner cap doesn't come off with the applicator holder and the user has to manually remove it from the container to access the powder product. This may allow the user to dust off the extra collected powder product inside the inner cap during application that is later reused during multiple applications.

A cosmetic package according to a second embodiment of the present disclosure may come without an applicator and an applicator holder. In the cosmetic package according to the second embodiment, the cap, therefore, is configured to be directly fastened to the container. The outer cap comprises threads on an inner surface of a sidewall of the outer cap for cooperating with corresponding threads provided on the outer surface of the container.

Like the first embodiment, the inner cap of the second embodiment also includes a flange projection at the open upper end thereof, a bottom wall, and a sidewall extending downwardly from the flange projection. However, unlike the first embodiment, the inner cap of the second embodiment is coupled to the outer cap rather than coupled to the applicator holder. In order to secure the inner cap with the cap, the inner surface of the sidewall of the outer cap includes a groove that is configured to receive the flange projection of the inner cap. Thus, when the outer cap is unscrewed from the container, the inner cap comes off along with the cap.

The inner cap comprises a notch on the flange projection on the open upper end of the inner cap. The outer cap includes a projection on a bottom surface of a top wall of the outer cap that interlocks with the notch of the inner cap so that the inner cap is rotationally locked with respect to the cap.

The rest features of the first and second embodiment are the same, and the difference therebetween lies only the applicator holder and applicator not being provided in the second embodiment, and therefore also the fitment of the inner cap is provided with the cap in the second embodiment. The rest of the constructions are all the same as the first embodiment. Therefore, the other parts of the constructions are not described.

To use the cosmetic package according to the second embodiment, a user first unthreads the outer cap from the container so that both the outer cap and the inner cap come off the container. The user can now access the powder product from the container by rotating the roller in a direction perpendicular to the direction of the two axle projections. The powder product is transferred from the cavity of the container onto the roller upon rotation and applied to the skin. The user may rotate the roller with the help of an external applicator or by using his or her fingers.

It will be understood that the foregoing is only illustrative of the principles of the disclosure and that various modifications can be made by those skilled in the art without departing from the scope and spirit of the disclosure. For example, the shapes and/or sizes of various components can be different from the shapes and sizes are shown herein. As another example, the materials used for various components can be different from those mentioned specifically herein.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the disclosure. In addition, those skilled in the art may readily change or modifications to the disclosed embodiments, based on the present specification, such changes or modifications also belong to the scope of the present disclosure will be apparent.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
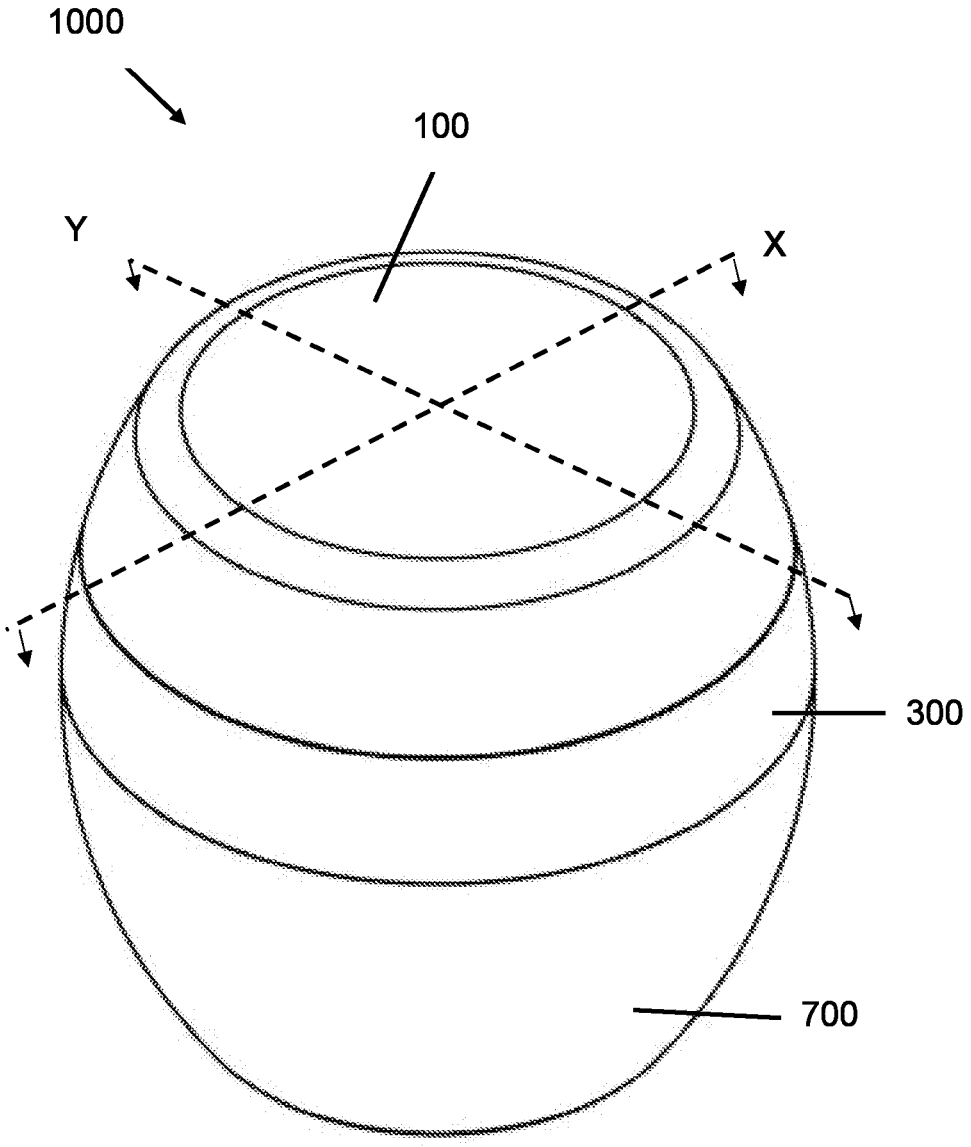
FIG. 1 illustrates a perspective view of a cosmetic package in a closed state, according to a first embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

FIGS. 1 to 5 illustrates a cosmetic package 1000 in accordance with a first embodiment of the present disclosure. The cosmetic package 1000 comprises an outer cap 100, an applicator 200, an applicator holder 300, an inner cap 400, an insert 500, a roller 600, a container 700, and a base plug 800. The container 700 stores a powder product (not shown) which is to be discharged on to a surface of the roller 600, wherein the powder product is selected from at least one of the cosmetic powder products or medicinal powder products. The powder product stored in the container 700 is preferably a loose powder product.

Figure 2:
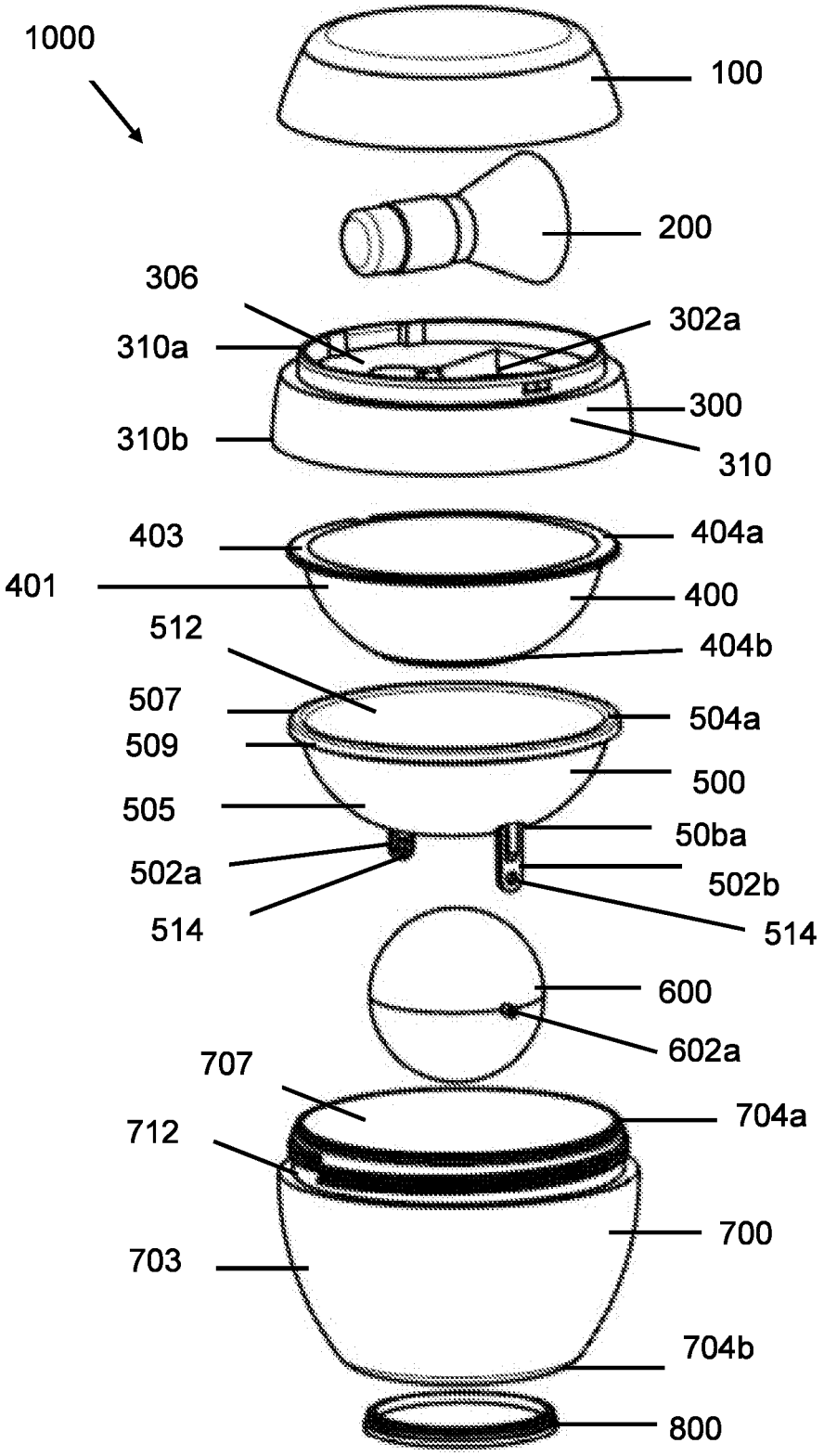
FIG. 2 illustrates an exploded perspective view of the cosmetic package of FIG. 1.
Figure 3:
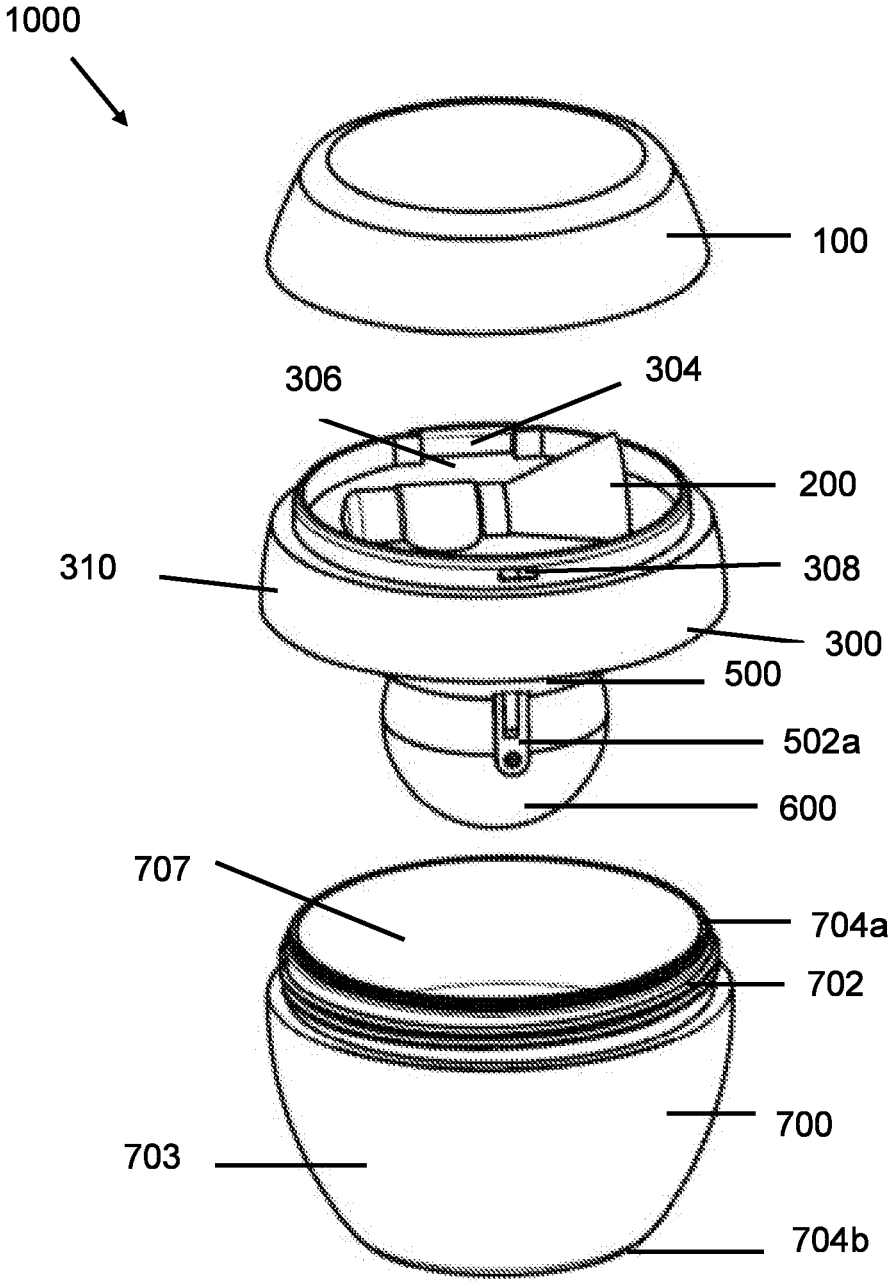
FIG. 3 illustrates a partially exploded perspective view of the cosmetic package of FIG. 1.

As shown in FIGS. 2 and 3, the outer cap 100 covers the cosmetic package 1000 and protects the cosmetic package 1000 from dust and dirt. The applicator holder 300 comprises a sidewall 310 defining an upper end 310*a* and a bottom end 310*b* of the applicator holder 300. The outer cap 100 is mounted on the upper end 310*a* of the applicator holder 300. The shape of the outer cap 100 is preferably circular in shape. However, the shape of the outer cap 100 may be rectangular, cuboidal, square, or other shapes known in the art.

Figure 4A:
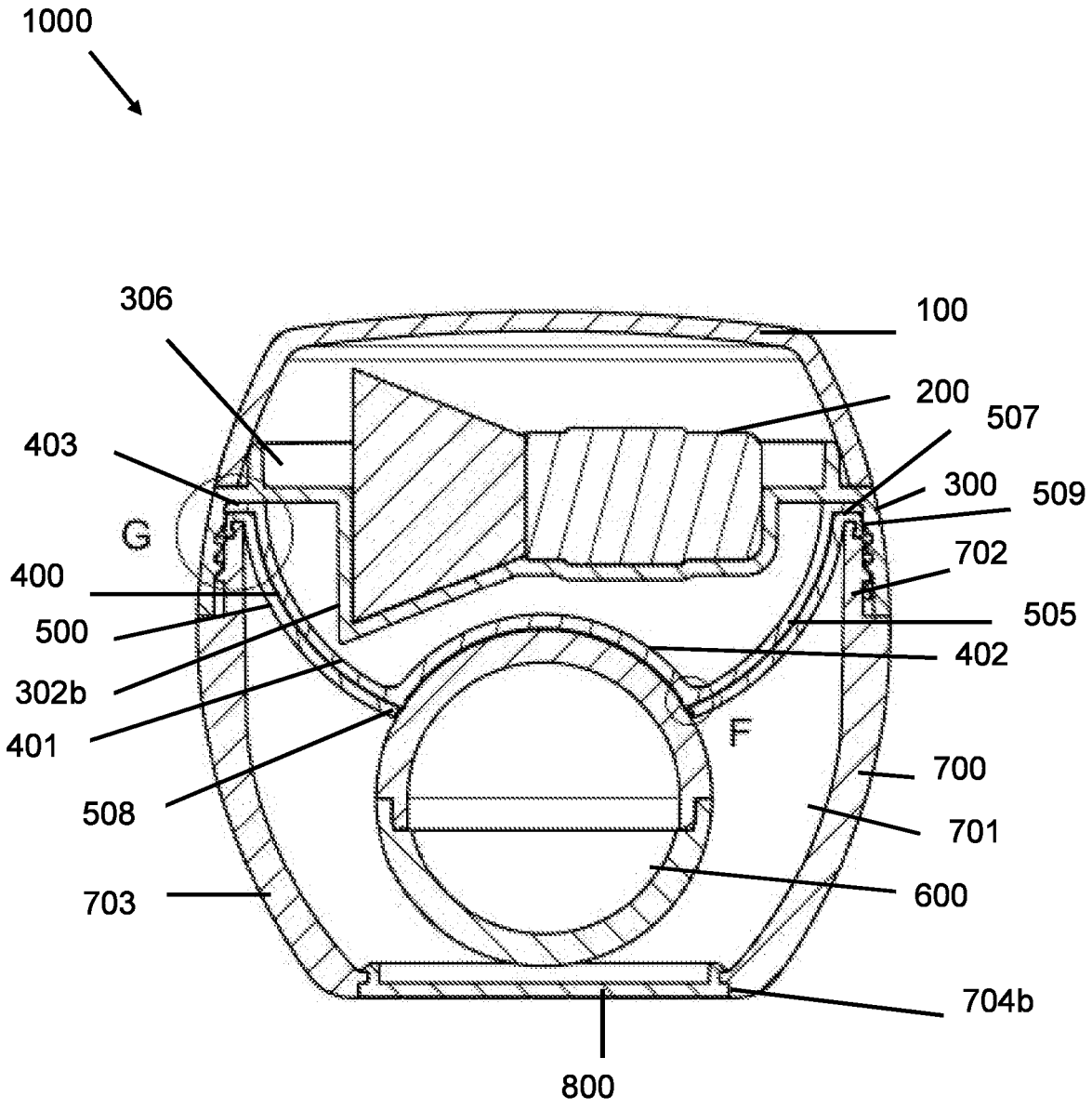
FIG. 4A illustrates a longitudinal cross sectional view taken along line X of FIG. 1.
Figure 5:
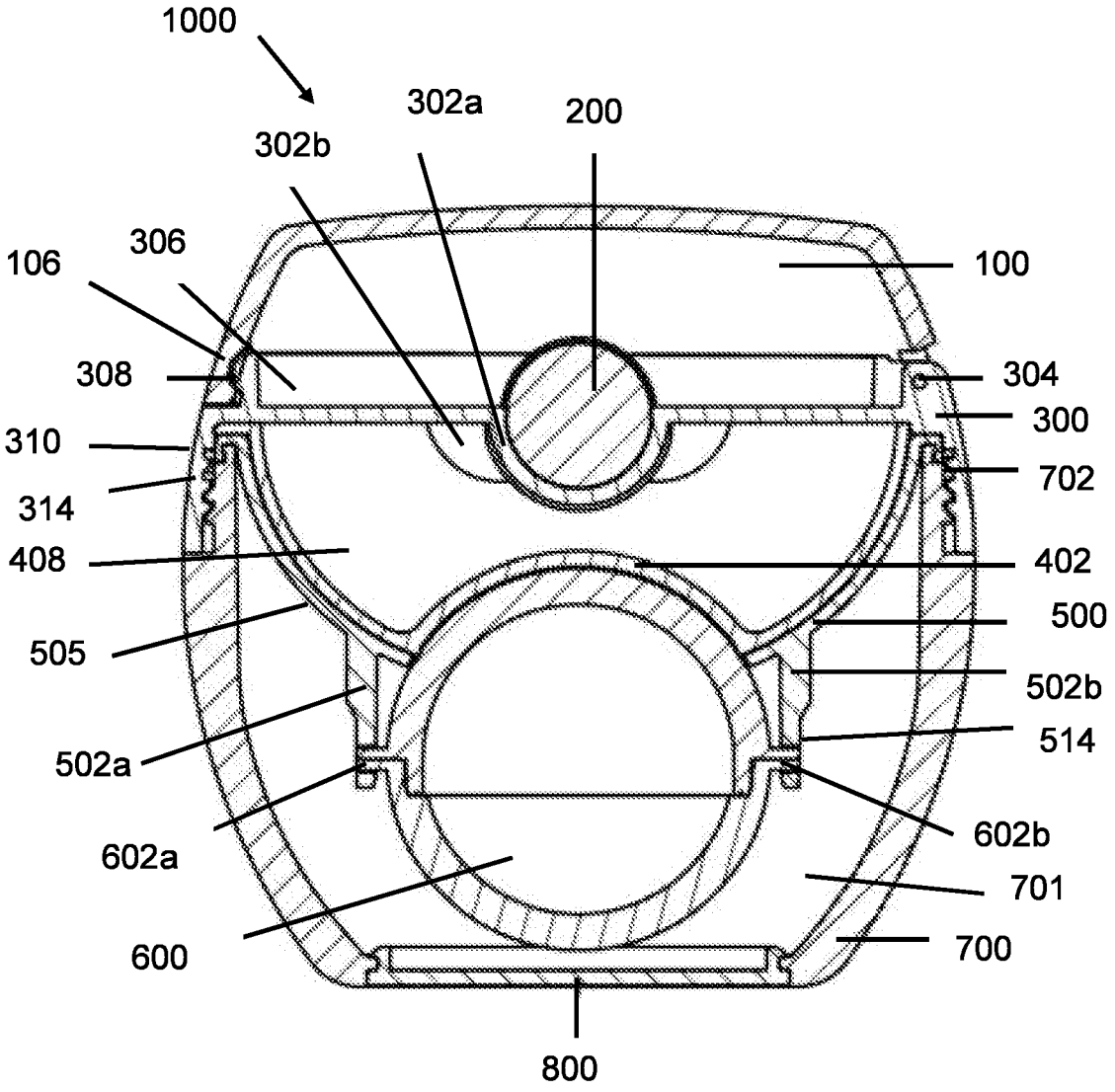
FIG. 5 illustrates a longitudinal cross sectional view taken along line Y of FIG. 1.

The container 700 comprises an open upper end 704*a* and an open bottom end 704*b*. The container 700 includes a sidewall 703 and a bottom wall defined by the separate base plug 800. The open bottom end 704*b* of the container 700 is closed by the base plug 800. As shown in FIGS. 4A & 5, the container 700 is connected with the base plug 800 at the open bottom end 704*b*, thus covering the open bottom end 704*b* of the container 700 to store the powder product. The base plug 800 defines the bottom for the container 700 as seen in FIGS. 3, 4A and 5. The base plug 800 is fixedly coupled to the container 700 such that they behave as a single unit. As seen in FIGS. 4A and 5, the base plug 800 is connected to the container 700 at the open bottom end 704*b* by means of a snap fitment. However, the base plug 800 may be connected to the container 700 at the open bottom end 704*b* by any other fitment means such as screws, threads, or other fitment means known in the art.

In an alternate embodiment, the base plug 800 and the container 700 may be made as a single integral piece.

As shown in FIGS. 2-4A, further, the container 700 has a cavity 707 for accommodating the powder product, and more particularly, the powder product is located in a cosmetics accommodating space 701 in the cavity 707 of the container 700. Further, the sidewall 703 of the container 700 defines a neck portion 712 near the open upper end 704*a* of the container 700. The neck portion 712 is reduced in outer diameter as compared with the rest of the sidewall 703. The shape of the container 700 is a bowl-shaped container.

The dimensions of the container 700 are sufficient enough to accommodate the roller 600 and the insert 500.

As seen in FIGS. 2 and 4A, the insert 500 is positioned within the container 700 where it fits above the powder product contained within the cosmetics accommodating space 701 of the cavity 707 of the container 700. The insert 500 is positioned co-axially inside the cavity 707 of the container 700. The insert 500 comprises an open bottom end 504*b* and an open upper end 504*a*. The insert 500 has a hollow structure of a defined geometrical shape. More specifically, the insert 500 is has a bowl-shaped structure. The insert 500 further includes a sidewall 505, an upper horizontal rim 507, and a skirt wall 509. The sidewall 505 of the insert 500 is concave and shaped like a bowl. An aperture 508 is defined at the bottom end 504*b* of the insert 500. The skirt wall 509 depends from an outer edge of the upper horizontal rim 507 of the insert 500, the sidewall of the insert 500 descends downwardly from an inner edge of the upper horizontal rim. The upper horizontal rim 507 and the skirt wall 509 thus form a structure that overlaps the open upper end 704*a* of the container 700. This overlapping structure anchors the insert 500 securely in the cavity 707 of the container 700.

Figure 4B:
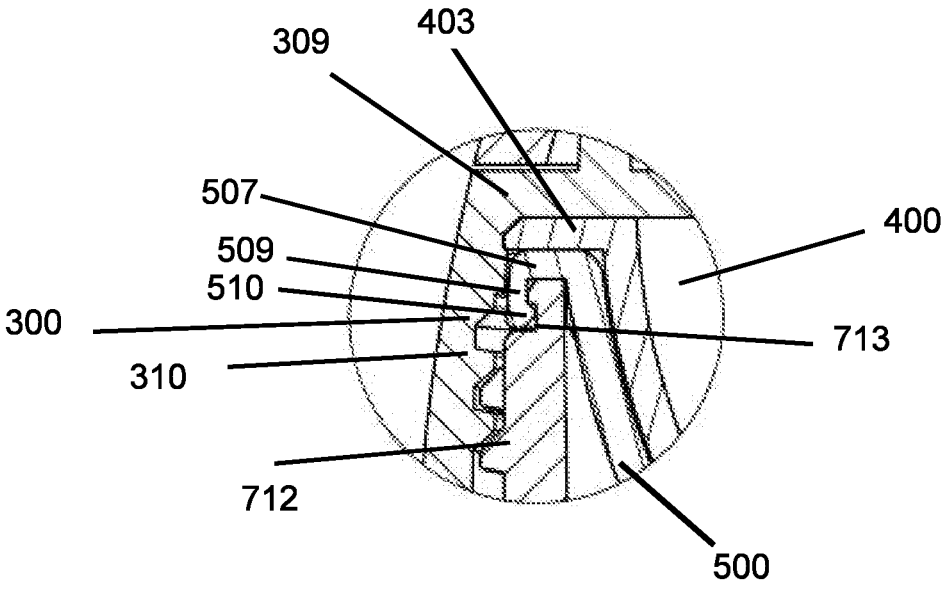
FIG. 4B illustrates an enlarged view of a circle G of FIG. 4A.

As shown in FIG. 4B, the insert 500 includes coupling features to be engaged with corresponding coupling features on an outer surface of the neck portion 712 of the container 700. The insert 500 further includes at least one protrusion 510, which may be positioned on an inner side of the skirt wall 509 of the insert 500 and may be configured to engage with the at least one corresponding groove 713 present on the outer surface of a neck portion 712 of the container 700. In this manner, the insert 500 may be snap-fitted into the container 700 and may be held within the cavity 707 of the container 700.

When the insert 500 is coupled with the container 700, the sidewall 505 extends along the longitudinal direction of the container 700 in the cavity 707 of the container 700. The cosmetics accommodating space 701 of the container 700 is formed below the sidewall 505, and a space above the upper surface of the sidewall 505 of the insert 500 forms an inner cap receiving space 512 therein, see FIGS. 2 and 4A. The inner cap receiving space 512 is formed to have a larger cross sectional area towards the open upper end 504*a*. At the end of the sidewall 505, the aperture 508 is formed. The inner cap receiving space 512 and the cosmetic accommodating space 701 form independent spaces with the aperture 508 for dispensing the powder product there between with the help of the roller 600.

The insert 500 may have a size and shape that corresponds with the size and shape of the container 700, thereby enclosing the product within the cosmetics accommodating space 701 of the container 700. The insert 500 and the container 700 may have a substantially round (e.g., circular or cylindrical) shape in which a seal may be provided by a suitable fastening mechanism, such as snap fastening as shown in FIGS. 4A and 5. However, it is contemplated that the insert 500 and the container 700 may have an alternative shape (e.g., square, rectangular, oval, triangular, or any other shape desired) and may be sealed by a magnetic fastening mechanism, a threading mechanism, or a clamp fastening system.

Referring to FIGS. 2 and 5, a bottom surface of the sidewall 505 of the insert 500 comprises two support members 502*a* and 502*b* extending downwardly therefrom, and are positioned on at least two opposite sides of the aperture 508 at the open bottom end 504*b* of the insert 500. At least one end of each of the two support members 502*a* and 502*b* is connected to the bottom surface of the sidewall 505 of the insert 500. Each of another end of the two support members 502*a* and 502*b* is a free end. The two support members 502*a* and 502*b* include opposing holes 514. The opposing holes 514 may or may not be see through.

In exemplary embodiment, as shown in FIG. 5, the roller 600 is spherical in shape and is attached to the support members 502*a* and 502*b* of the insert 500 near the bottom end portion of the insert 500 such that at least some portion of the roller 600 is positioned within the cosmetics accommodating space 701 of the cavity 707 of the container 700, and at least another portion of the roller 600 extends out from the cosmetics accommodating space 701 through the aperture 508 of the insert 500. The roller 600 is configured to rotate in a defined direction about an axis for discharging a controlled amount of the powder product from cosmetics accommodating space 701 of the container 700 through the aperture 508 of the insert 500. The powder product adheres on to an outer surface of the portion of the roller 600 that is positioned inside the cosmetics accommodating space 701, and on the rotation of the roller 600, the portion of the roller 600 is exposed outside from the aperture 508 of the insert 500 allowing a user to collect the powder product from the outer surface of the roller 600.

In exemplary embodiment, as shown FIGS. 4A and 5, the roller 600 is manufactured in two parts and is later integrated to form a roller 600. The two parts of the roller 600 comprises two halves that are semi-spherical. The roller 600 includes two opposing axle projections 602*a*, 602*b* on the outer surface of the roller 600. Each of the two opposing axle projections 602*a*, 602*b* is partially defined by two halves of the roller 600. The two halves of the roller 600 are joined together to form the spherical roller 600 and the two opposing axle projections 602*a*, 602*b*, namely a first axle projection 602*a* and a second axle projection 602*b*. The holes 514 present in the two support members 502*a* and 502*b* rotatably accommodate the opposing axle projections 602*a* and 602*b* by which the roller 600 is mounted in position. Thus, the opposing axle projections 602*a* and 602*b* of the roller 600 are connected to the two support members 502*a* and 502*b* respectively of the insert 500 for free rotation of the roller 600 on a single axis. More particularly, the two support members 502*a*, 502*b* of the insert 500 comprises of a left support member 502*a* and a right support member 502*b*, wherein the left support member 502*a* and the right support member 502*b* are connected to the first axle projection 602*a* and the second axle projection 602*b* respectively, refer FIG. 5. The roller 600 rotates about an axis lying in direction of the interlocking of the two opposing axle projections 602*a* and 602*b* with the support members 502*a* and 502*b*.

As shown in FIGS. 4A and 5, at least a portion of the roller 600 is exposed through the aperture 508 at the open bottom end 504*b* for application.

The roller 600 can rotates in a clock-wise and an anti-clockwise direction for discharging the powder product. During rotation, an exposed top portion of the roller 600 moves in a downward direction, and a bottom portion of the roller 600 that is accommodated in the cosmetics accommodating space 701 carries the powder product and moves in an upward direction for discharging the powder product. Meanwhile, the top portion of the roller 600 moves downward, touches the powder product and carries a controlled quantity of powder product, and moves upward on further rotation. The movement of the roller 600 covers a complete circle for continuously discharging the powder product during application.

Figure 4C:
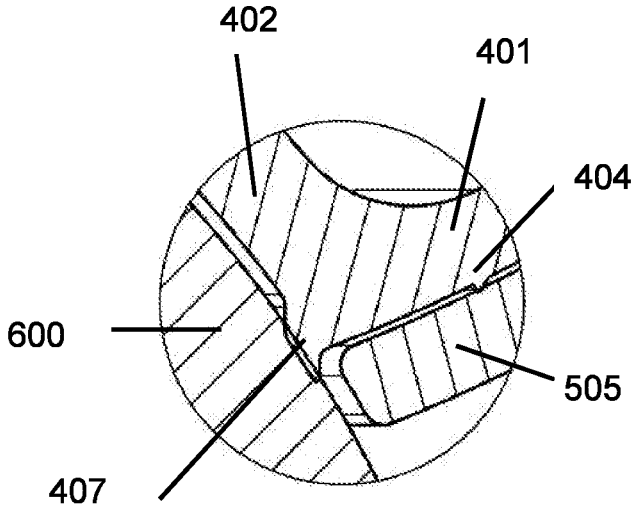
FIG. 4C illustrates an enlarged view of a circle F of FIG. 4A.

As shown in FIGS. 2 and 4A, the inner cap 400 comprises an open upper end 404*a* and a closed bottom end 404*b*. The inner cap 400 includes a flange projection 403 at the open upper end 404*a* thereof, a bottom wall 402, and a sidewall 401 extending downwardly from the flange projection 403. The inner cap 400 has a size and shape that corresponds with the size and shape of the container 700 and the insert 500. The inner cap 400 is configured to be received in the inner cap receiving space 512 of the insert 500 such that the flange projection 403 of the inner cap 400 rests on the upper horizontal rim 507 of the insert 500, and the sidewall 505 of the insert 500 and the sidewall 401 of the inner cap 400 may be flushed with one another, thereby enclosing the powder product within the cosmetics accommodating space 701 of the container 700. When the inner cap 400 is placed over the insert 500, the inner cap 400 forms a tight seal with the insert 500 and the roller 600 to prevent leakage of powder product from the cosmetics accommodating space 701 of the container 700. More particularly, the sidewall 401 of the inner cap 400 sealingly rests on an upper surface of the sidewall 505 of the insert 500. More particularly, as shown in FIG. 4C, an outer surface of the sidewall 401 of the inner cap 400 includes a protrusion 404 that abuts and make a tight seal with an inner surface of the sidewall 505 of the insert 500 to prevent leakage of powder product from the container 700 between the insert 500 and the inner cap 400. Further, a bottom surface of the bottom wall 402 of the inner cap 400 includes an annular protrusion 407 that rests on a top surface of the roller 600, which is exposed through the aperture 508, to tight seal and prevents leakage of powder product from the container 700. The annular protrusion 407 creates a space between the bottom surface of the bottom wall 402 of the inner cap 400 and the top portion of the roller 600 for the reception of a little quantity of the powder product. The diameter of the inner cap 400 is substantially equal to the diameter of the insert 500.

According to an embodiment, the bottom wall 402 of the inner cap 400 is a convex structure forming a concave cavity at a bottom surface of the bottom wall 402. The concave cavity provides a space for accommodating the exposed top portion of the roller 600. The concave cavity is a semi-sphere having a diameter of about at least one-third of the diameter of the roller 600.

According to an embodiment, the concave cavity of the bottom wall 402 covers at least one-third portion of the roller 600. However, the diameter of the concave cavity of the bottom wall 402 may be adjusted for covering a desired portion of the roller 600 depending on the exposure of the roller 600 from the aperture 508 of the insert 500.

The applicator holder 300 according to present embodiment is shown in FIGS. 2, 3, 4A, 5, 6 and 7. As shown in FIG. 2, the applicator holder 300 has an upper end 310*a* and a bottom end 310*b*. The applicator holder 300 comprises a sidewall 310, a horizontal wall 306 extending horizontally from an inner surface of the sidewall 310 of the applicator holder 300. The horizontal wall 306 includes a recess 302*a* shaped and sized to receive and store the applicator 200 therein. The recess 302*a* of the applicator holder 300 thus resembles the shape of the applicator 200. The user uses the applicator 200 to rotate the roller 600 for discharging and collecting the powder product from the outer surface of the roller 600. An outer shape of the applicator holder 300 resembles the outer shape of the outer cap 100. More specifically, the outer shape of the applicator holder 300 is circular in shape. However, in alternate embodiments, the shape of the applicator holder 300 and the outer cap 100 may be rectangular, cuboidal, square, or other shapes known in the art. The length of the recess 302*a* extends along the length of the horizontal wall 306. The applicator 200 is protected from the external environment when the upper end 310*a* of the applicator holder 300 is covered by the outer cap 100.

Figure 6:
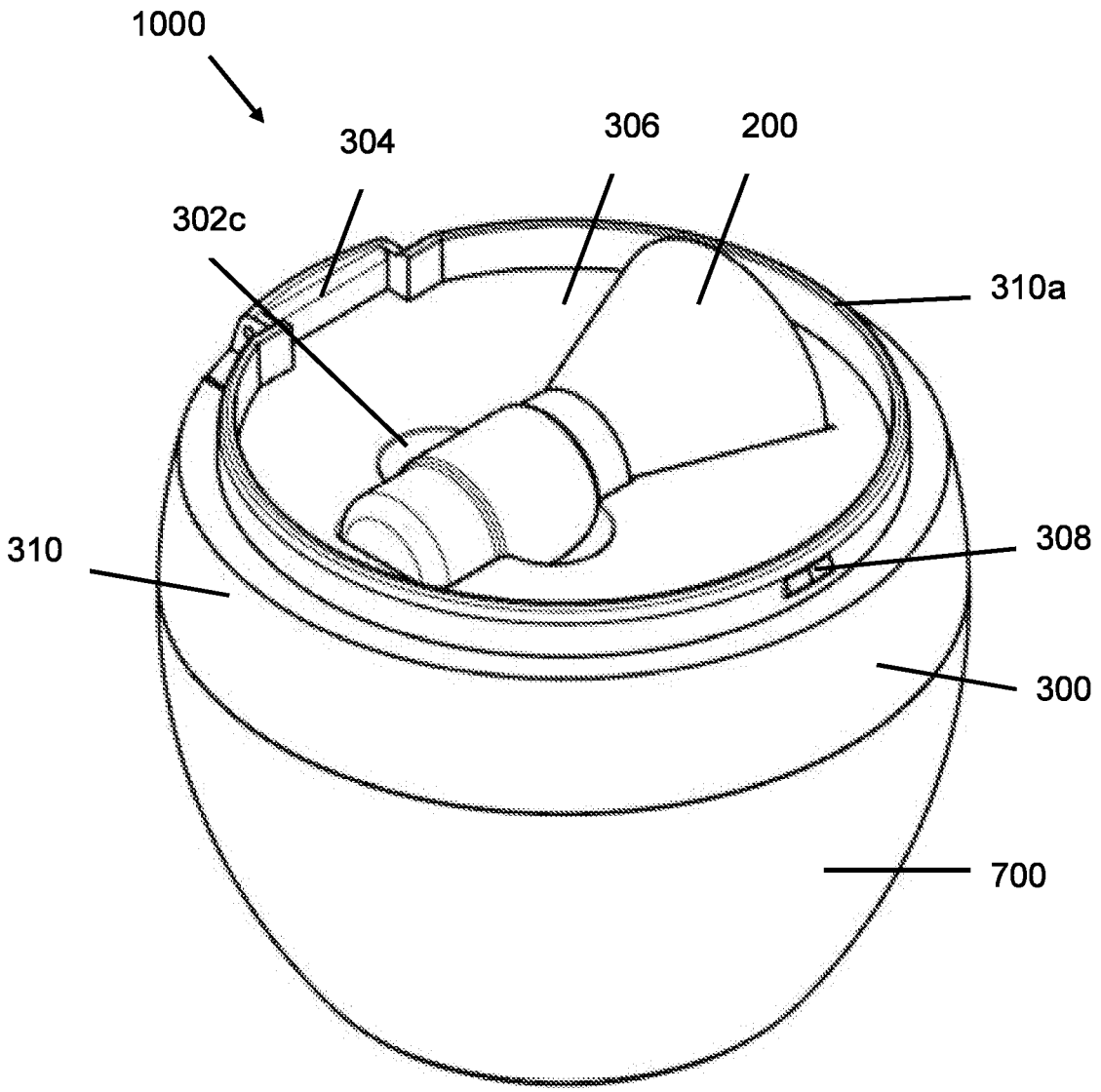
FIG. 6 illustrates an isometric view of the cosmetic package without an outer cap of the cosmetic package of FIG. 1.

As shown in FIGS. 3, 5 and 6, the horizontal wall 306 comprises an upper surface, a bottom surface, and wherein the recess 302*a* formed on the upper surface of the horizontal wall 306 for accommodating the applicator 200. The upper surface of the horizontal wall 306 includes the recess 302*a* and at least one clearance groove 302*c*. More particularly, at least two clearance grooves 302*c* are provided adjacent to the two sides of the recess 302*a*, wherein the two clearance grooves 302*c* are sized in such a manner that they provide space wherein a user can engage his/her fingers in order to remove the applicator 200 from the recess 302*a* of the applicator holder 300 comfortably.

Figure 7:
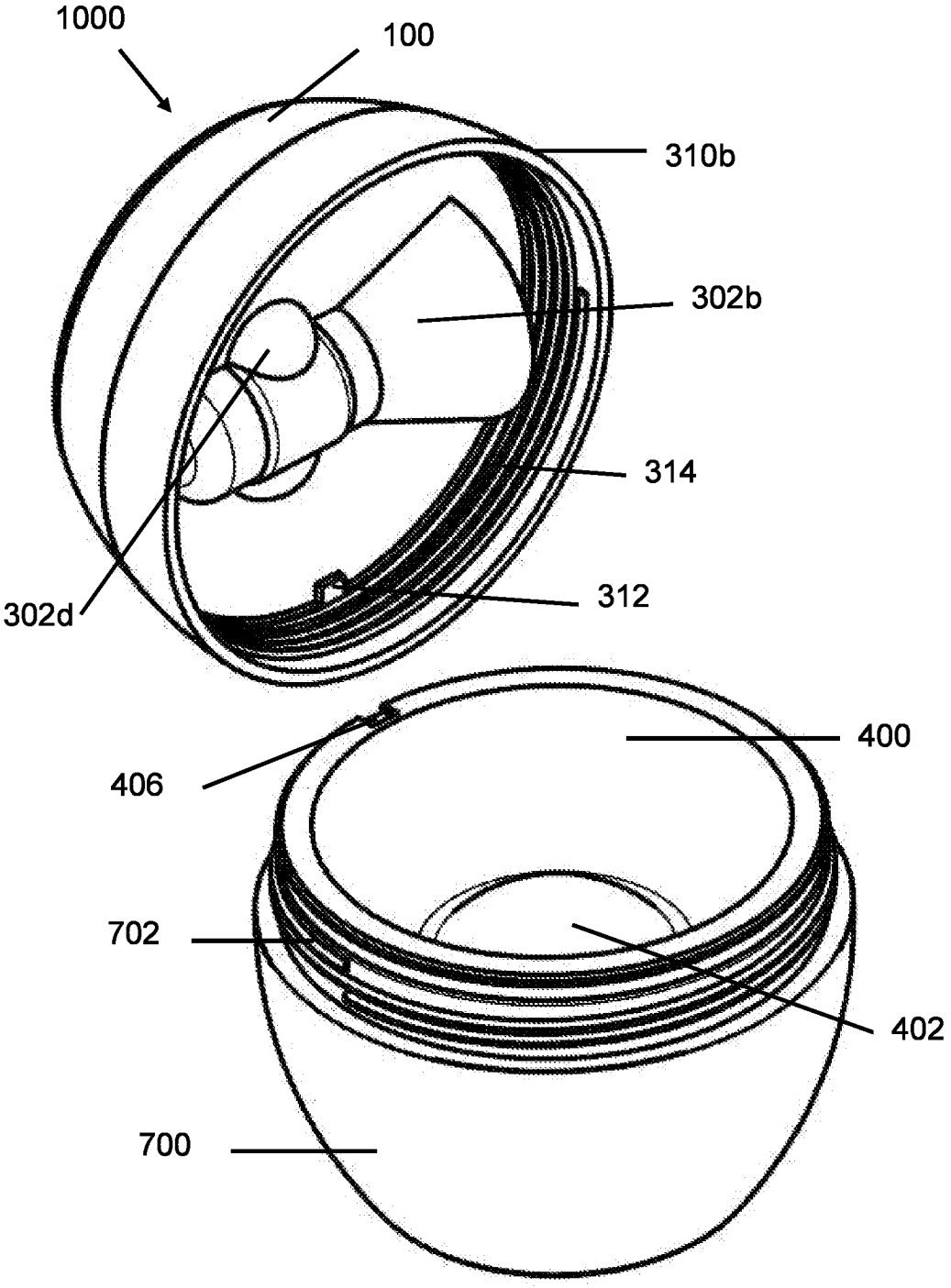
FIG. 7 illustrates a partially exploded perspective of the cosmetic package of FIG. 1, showing a cap and an applicator holder separated from a container of the cosmetic package to show the interior structure thereof.

As shown in FIG. 7, the bottom surface opposite to the upper surface of the horizontal wall 306 of the applicator holder 300 includes a first protrusion 302*b* opposite to the recess 302*a* and second protrusions 302*d* opposite to the two clearances 302*c*. The shape of the first protrusion 302*b* depicts the shape of the applicator 200 stored in the recess 302*a*. The second protrusions 302*d* are adjacent the two sides of the first protrusion 302*b*. The second protrusions 302*d* are formed due to the presence of the clearances 302*c* on the opposite surface of the horizontal wall 306.

As shown in FIG. 5, an inner surface of the sidewall 310 of the applicator holder 300 includes a fastening means 314 that are engaged with corresponding fastening means 702 provided on the outer surface of the neck portion 712 of the container 700. According to the present embodiment, the fastening means 702 is preferably a threaded means comprising of threads along the outer periphery of the neck portion 712 of the container 700 that fits with the threads 314 of opposite profile present along the inner periphery of the sidewall 310 of the applicator holder 300.

Furthermore, the open upper end 404*a* of the inner cap 400 is fixedly and non-rotatably engaged to a bottom side of the applicator holder 300. As shown in FIG. 4B, the inner surface of the sidewall 310 of the applicator holder 300 includes a groove 309 that is configured to receive the flange projection 403 of the inner cap 400 so in order to couple the inner cap 400 with the applicator holder 300. Thus, when the applicator holder 300 is unscrewed from the container 700, the inner cap 400 comes off along with the applicator 300.

According to various alternative embodiments, the flange projection 403 may be coupled to the side wall 310 of the applicator holder 300 in any suitable manner (e.g., welding, snap fit, etc.)

The applicator holder 300, the inner cap 400, and the insert 500 along with the roller 600 are positioned co-axially connecting one another in the above sequence. The applicator holder 300 and the insert 500 are fastened to the container 700 such that the inner cap 400 and the insert 500 along are positioned co-axially inside the container 700.

The applicator 200 touches the surface of the roller 600 to collect the powder product upon rotation of the roller 600. In an embodiment, the applicator 200 rotates the roller 600 for discharging the powder product on the surface of the applicator 200. However, the roller 600 may also be rotated using the fingers of the user or any other tool.

The applicator 200 when placed in the applicator holder 300 is protected from dust and dirt by the outer cap 100 that covers the applicator holder 300. The outer cap 100 is connected to the upper end 310*a* of the applicator holder 300.

As shown in FIG. 5, the outer cap 100 is hingly coupled to the sidewall 310 of the applicator holder 300. The hinge 304 allows the outer cap 100 to be pivotally connected to the applicator holder 300 by at least one side. The hinge 304 is made proximate to the upper end 310*a* on the sidewall 310 of the applicator holder 300. More particularly, the applicator holder 300 is fixedly coupled to the outer cap 100 about the hinge 304 that provides for pivotal movement of the outer cap 100 relative to applicator holder 300 between an open position and a closed position. According to the embodiment illustrated, the hinge 304 includes a pivot shaft pin 304 that is received within the corresponding opening in the outer cap 100 and applicator holder 300 and that defines a pivot axis about which the outer cap 100 is configured to rotate between the open position and the closed position.

As shown in FIGS. 5 and 6, an outer surface of the sidewall 310 of the applicator holder 300 includes a locking member 308 that engages with a corresponding locking member 106 provided on an inner surface of the outer cap 100 for securely engaging the outer cap 100 with the applicator holder 300. More particularly, the outer cap 100 includes a groove 106 that interlocks with a protruded lock 308. The outer cap 100 is opened by unlocking the protruded lock 308 from the groove 106 of the outer cap 100. The protruded lock 308 is located circumferentially opposite to the hinge 304 on the sidewall 310 of the applicator holder 300.

According to an aspect of the present disclosure, as shown in FIG. 5, when the applicator holder 300 is mounted over the container 700, the recess 302*a* of the applicator holder 300 extends into a cavity 408 of the inner cap 400. More particularly, a maximum depth of the recess 302*a* of the applicator holder 300 is such that the recess 302*a* at its maximum depth extends more than a third of the depth of the cavity 408 of the inner cap 400. Further, a depth of the recess 302*a* at a location other than the maximum depth of the recess 302*a* extends less than a third of the depth of the cavity 408 of the inner cap 400. More specifically, in the present embodiment, a portion of the recess 302*a* that exceeds more than a third of the depth of the inner cap 400 is configured to house an applicator head of the applicator 200. Another portion of the recess 302*a* that extends less than a third of the depth of the cavity 408 of the inner cap 400 is configured to receive a handle portion of the applicator 200.

According to an embodiment, the applicator holder 300 is circular in shape and is identical to the shape of the container 700. However, the shape of the applicator holder 300 may vary based on the shape of the applicator 200.

As shown in FIG. 7, the bottom second surface of the horizontal wall 306 comprises a securing means 312 which is a projection 312 for securing the applicator holder 300 with the inner cap 400. The inner cap 400 comprises a notch 406 on the flange projection 403 on the upper end 404*a*. The projection 312 of the applicator holder 300 interlocks with the notch 406 of the inner cap 400 so that the inner cap 400 is rotationally locked with respect to the applicator holder 300.

In order to use the cosmetic package 1000, the user pivotally opens the outer cap 100 and removes the applicator 200 from the recess 302*a* of the applicator holder 300. The applicator 200 is held and removed easily by lifting the applicator 200 from the recess 302*a* by the clearance 302*c*. Then, the applicator holder 300 is unthreaded from the container 700, and wherein on unthreading the applicator holder 300, the inner cap 400 and the outer cap 100 is also removed along with the applicator holder 300 as they are irremovably secured to the applicator holder 300. As the inner cap 400 gets removed from the container 700, the user can access the powder product by rotating the roller 600 exposed from the aperture 508 of the insert 500.

The user rotates the roller 600 using the applicator 200 in a direction perpendicular to the direction of the two opposing axle projections 602*a* and 602*b*. The applicator 200 collects the powder product that gets adhered to the surface of the roller 600 on rotation and transfers the powder product to the user's skin.

In alternate embodiments, not shown, the inner cap 400 may not be fixedly assembled to the applicator holder 300. Thus, when the applicator holder 300 is unscrewed from the container 700, the inner cap 400 doesn't come off with the applicator holder 300 and the user has to manually remove it from the container 700 to access the powder product. This may allow the user to dust off the extra collected powder product inside the inner cap 400 during application that is later reused during multiple applications.

Figure 8:
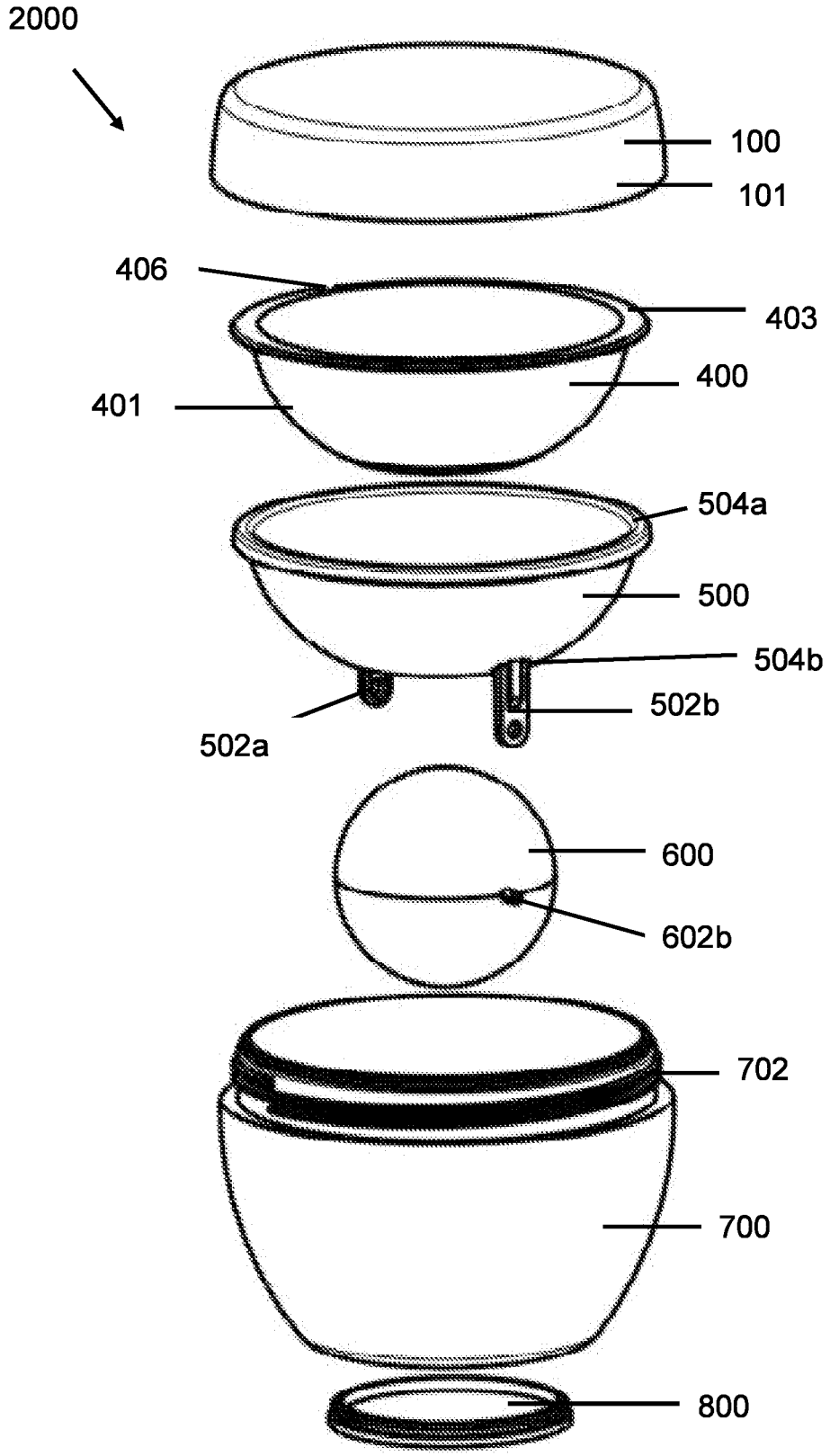
FIG. 8 illustrates an exploded view of cosmetic package without an integrated applicator according to a second embodiment of the present disclosure.
Figure 9:
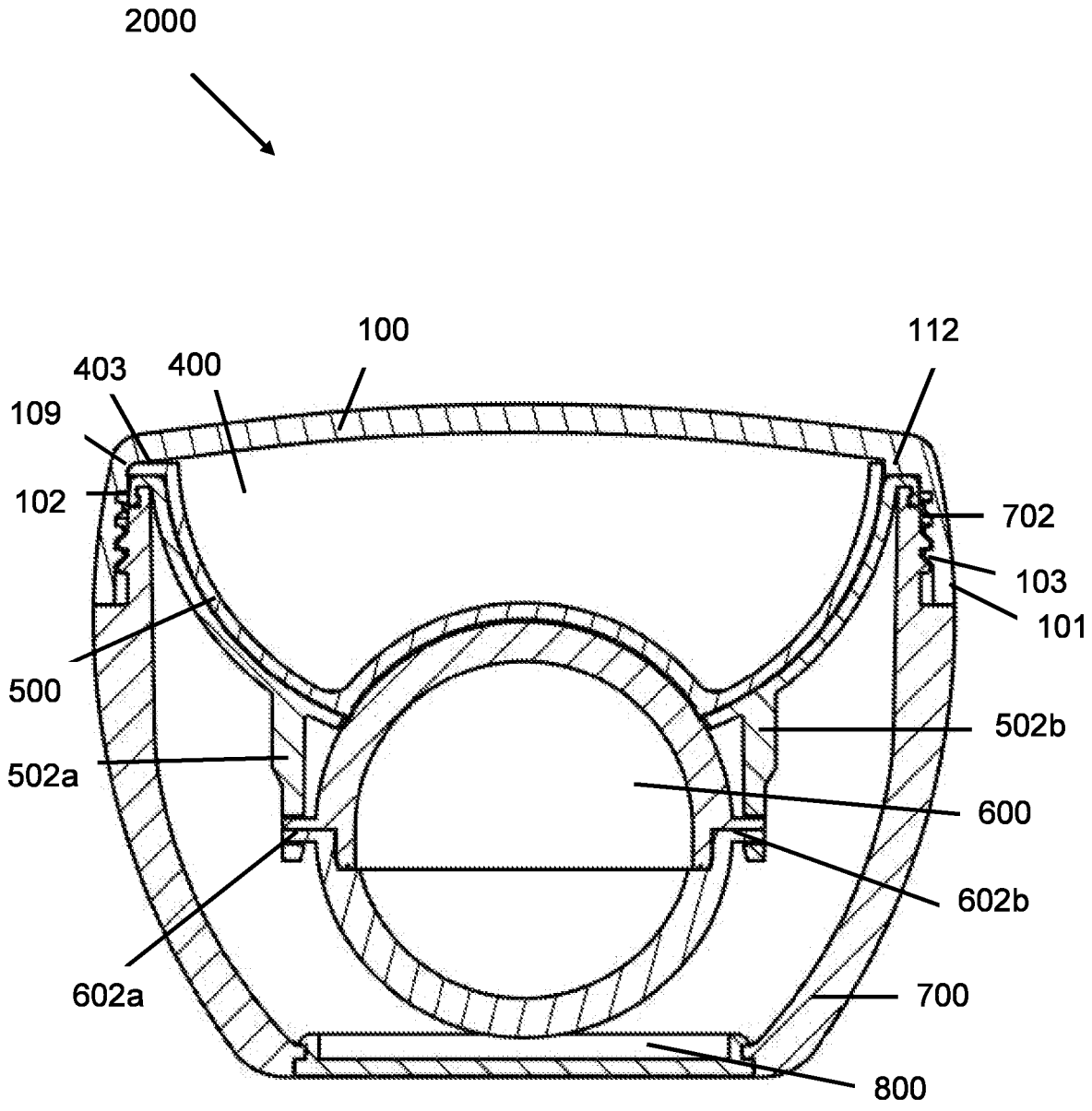
FIG. 9 illustrates a longitudinal cross sectional view of the cosmetic package of FIG. 8.

FIGS. 8 to 10 show a cosmetic package 2000 according to a second embodiment of the present disclosure. The cosmetic package 2000 is similar in construction and working to the cosmetic package 1000 of the first embodiment except for some minor modifications in shape and size of the components. The cosmetic package 2000 comprises a container 700, a base plug 800, a roller 600, an insert 500, an inner cap 400, and an outer cap 100. The cosmetic package 2000 of the second embodiment does not comprise an applicator holder 300 and associated applicator 200 as provided in first the embodiment.

As shown in FIG. 9, the outer cap 100 is configured to be directly fastened to the container 700. The outer cap 100 comprises threads 103 on an inner surface of a sidewall 101 of the outer cap 100 for cooperating with corresponding threads 702 provided on the outer surface of the container 700. The outer cap 100 covers the cosmetic package 2000 and protects the cosmetic package from dust and dirt. The shape of the outer cap 100 is preferably circular in shape. However, the shape of the outer cap 100 may be rectangular, cuboidal, square or other shape known in the art.

Like the first embodiment, the inner cap 400 of the second embodiment also includes a flange projection 403 at the open upper end 404*a* thereof, a bottom wall 402, and a sidewall 401 extending downwardly from the flange projection 403. The inner cap 400 has a size and shape that corresponds with the size and shape of the container 700 and the insert 500. However, unlike the first embodiment, the inner cap 400 of the second embodiment is coupled to the outer cap 100 rather than coupled to the applicator holder 300. Furthermore, as shown in FIG. 9, the inner surface of the sidewall 101 of the outer cap 100 includes a groove 109 which is configured to receive the flange projection 403 of the inner cap 400 in order to couple the inner cap 400 with the outer cap 100. Thus, when the outer cap 100 is unscrewed from the container 700, the inner cap 400 comes off along with the outer cap 100.

The inner cap 400 comprises a notch 406 on the flange projection 403 on the upper end 404*a* of the inner cap 400. The outer cap 100 includes a projection 112 on a bottom surface of a top wall of the outer cap 100 that interlocks with the notch 406 of the inner cap 400 so that the inner cap 400 is rotationally locked with respect to the outer cap 100.

The rest features of the first and second embodiment are the same, and the difference there between lies only the applicator holder 300 and applicator 200 not being provided in the second embodiment, and therefore also the fitment of the inner cap 400 is provided with the outer cap 100 in the second embodiment. The rest of the constructions are all the same as the first embodiment. Therefore, same reference numerals are given in the figures and the other parts of the constructions will not be described.

To use the cosmetic package 2000, a user first unthreads the outer cap 100 from the container 700 so that both the outer cap 100 and the inner cap 400 come off the container 700. The user can now access the powder product from the container 700 by rotating the roller 600 in a direction perpendicular to the direction of the two axle 602*a* and 602*b*. The powder product is transferred from cosmetics accommodating space 701 of the cavity 707 of the container 700 on to the roller 600 upon rotation. The user may rotate the roller 600 and collect the powder product therefrom with the help of an external applicator or by using his or her fingers.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. A cosmetic package for discharging a powder product comprising:

a container comprising a cavity extending between an open upper end and an open bottom end of the container, at least a portion of the cavity defines a cosmetics accommodating space for storing the powder product, a base plug fixedly coupled at the open bottom end of the container such that the container and the base plug behave as a single unit;

an insert mounted on the container such that the insert is positioned within the cavity of the container above the cosmetics accommodating space, a roller secured to a bottom surface of a sidewall of the insert such that at least a portion of the roller is positioned within the cosmetics accommodating space of the container;

an inner cap configured to rest on the insert such that the sidewall of the insert and a sidewall of the inner cap flush with one another;

an applicator holder removably coupled to the container at the open upper end of the container;

an outer cap coupled to an upper end portion of the applicator holder;

wherein the applicator holder comprises a recess for accommodating an applicator therein;

wherein the sidewall of the insert comprises an open upper end and an open bottom end, the open bottom end of the sidewall of the insert defines an aperture;

wherein an open upper end of the inner cap is fixedly and non-rotatably engaged to a bottom side of the applicator holder;

wherein two support members extend downwards from the bottom surface of the sidewall of the insert, wherein the two support members are opposingly located about a periphery of the aperture of the insert;

wherein the roller comprises two opposing axle projections on an outer surface of the roller;

wherein each of the two support members includes a hole for rotatably engaging with one of the two opposing axle projections of the roller to allow the roller to rotate freely about an axis of the two opposing axle projections;

wherein the two support members rotatably accommodate the two opposing axle projections of the roller such that the at least a portion of the roller is disposed rotatably within the cosmetics accommodating space of the container, and at least another portion of the roller extends outside the cosmetics accommodating space from the aperture located at the open bottom end of the insert; and wherein an upper surface of the sidewall of the insert forms an inner cap receiving space to receive the inner cap that forms a tight seal with the insert and the roller to prevent leakage of powder product from the cosmetics accommodating space of the container.

2. A cosmetic package according to claim 1, wherein the insert includes an upper horizontal rim, a skirt wall that depends from an outer edge of the upper horizontal rim, and the sidewall of the insert descends downwardly from an inner edge of the upper horizontal rim.

3. A cosmetic package according to claim 2, wherein the insert includes at least one protrusion which are positioned on an inner side of the skirt wall of the insert; wherein the at least one protrusion is configured to engage with an corresponding groove present on an outer surface of a neck portion of the container.

4. A cosmetic package according to claim 1, wherein the sidewall of the insert is concave.

5. A cosmetic package according to claim 1, wherein the hole is a see-through cavity.

6. A cosmetic package according to claim 1, wherein the roller is spherical in shape.

7. A cosmetic package according to claim 1, wherein the roller is manufactured in two parts and is later integrated to form the roller; wherein the two parts of the roller comprises two halves that are semi-spherical; and wherein each of the two opposing axle projections of the roller is partially defined by the two halves of the roller.

8. A cosmetic package according to claim 1, wherein the inner cap comprises an open upper end and a closed bottom end, wherein the inner cap includes a flange projection at the open upper end thereof, a bottom wall, and the sidewall extending downwardly from the flange projection.

9. A cosmetic package according to claim 8, wherein the inner cap is configured to be received in the inner cap receiving space of the insert such that the flange projection of the inner cap rests on an upper horizontal rim of the insert, and the sidewall of the insert and the sidewall of the inner cap flush with each another, thereby enclosing the powder product within the cosmetics accommodating space of the container.

10. A cosmetic package according to claim 9, wherein an outer surface of the sidewall of the inner cap includes a protrusion that abuts and make a tight seal with the upper surface of the sidewall of the insert to prevent leakage of powder product from the container between the insert and the inner cap; wherein a bottom surface of the bottom wall of the inner cap includes an annular protrusion that rests on a top surface of the roller, which is exposed through the aperture, to tight seal and prevents leakage of powder product from the container.

11. A cosmetic package according to claim 10, wherein an upper surface of the bottom wall of the inner cap is convex forming a concave cavity at the bottom surface of the bottom wall; wherein the concave cavity provides a space for accommodating a portion of the roller that is exposed out from the cosmetics accommodating space through the aperture of the insert.

12. A cosmetic package according to claim 10, wherein the concave cavity of the inner cap is a semi-spherical and encloses at least one-third of the outer surface of the roller.

13. A cosmetic package according to claim 1, wherein the applicator holder comprises a sidewall, a horizontal wall extending horizontally from an inner surface of the sidewall of the applicator holder; wherein the horizontal wall comprises an upper surface, a bottom surface, and wherein the recess is formed on the upper surface of the horizontal wall for accommodating the applicator.

14. A cosmetic package according to claim 13, wherein a projection is provided on the bottom surface of the horizontal wall of the applicator holder that interlocks with a notch on a flange projection of the inner cap so that the inner cap is rotationally locked with respect to the applicator holder.

15. A cosmetic package according to claim 13, the horizontal wall of the applicator holder comprises at least two clearance grooves that are provided adjacent to two sides of the recess, wherein the two clearance grooves are sized such that they provide space wherein a user can engage his/her fingers in order to remove the applicator from the recess of the applicator holder.

16. A cosmetic package according to claim 13, wherein the inner surface of the sidewall of the applicator holder includes threads that engage with corresponding threads present along an outer periphery of a neck portion of the container.

17. A cosmetic package according to claim 13, wherein the inner surface of the sidewall of the applicator holder includes a groove that is configured to receive a flange projection of the inner cap in order to couple the inner cap with the applicator holder.

18. A cosmetic package according to claim 1, wherein the outer cap is hingly coupled to a sidewall of the applicator holder.

19. A cosmetic package according to claim 1, wherein when the applicator holder is coupled to the container, the recess of the applicator holder extends into a cavity of the inner cap; wherein the recess of the applicator holder at its maximum depth extends into the cavity of the inner cap more than a third of a depth of the cavity of the inner cap.

20. A cosmetic package for discharging a powder product comprising:

a container comprising a cavity extending between an open upper end and an open bottom end of the container, at least a portion of the cavity defines a cosmetics accommodating space for storing the powder product, a base plug fixedly coupled at the open bottom end of the container such that the container and the base plug behave as a single unit;

an insert mounted on the container such that the insert is positioned within the cavity of the container above the cosmetics accommodating space, a roller secured to a bottom surface of a sidewall of the insert such that at least a portion of the roller is positioned within the cosmetics accommodating space of the container;

an inner cap comprising a bottom wall and a sidewall, the inner cap is configured to rest on the insert when the cosmetic package is in a closed state;

wherein the insert comprises an open upper end and an open bottom end, the open bottom end of the insert defines an aperture;

wherein two support members extend downwards from the bottom surface of the sidewall of the insert, wherein the two support members are opposingly located about a periphery of the aperture of the insert;

wherein the roller is spherical and comprises two opposing axle projections on an outer surface of the roller;

wherein each of the two support members includes a hole for rotatably engaging with one of the two opposing axle projections of the roller to allow the roller to rotate freely about an axis of the two opposing axle projections;

wherein the two support members rotatably accommodates the two opposing axle projections of the roller such that the at least a portion of the roller is disposed rotatably within the cosmetics accommodating space of the container, and at least another portion of the roller extends outside the cosmetics accommodating space from the aperture located at the open bottom end of the insert;

wherein as the roller rotates, the outer surface of the portion of the roller that is positioned inside the cosmetics accommodating space picks the powder product from the cosmetics accommodating space of the container and is exposed to outside from the aperture of the insert;

wherein an outer surface of the sidewall of the inner cap includes a protrusion that abuts and make a tight seal with an upper surface of the sidewall of the insert to prevent leakage of powder product from the container between the insert and the inner cap when the cosmetic package is in a closed state; and wherein a bottom surface of a bottom wall of the inner cap includes an annular protrusion that rests on a top surface of the roller, which is exposed through the aperture, to tight seal and prevents leakage of powder product from the container when the cosmetic package is in the closed state.

* * * * *